United States Patent [19]

Quandt et al.

[11] 4,070,813

[45] Jan. 31, 1978

[54] OPEN END SPINNING UNIT HAVING REDUCED OPERATING POWER REQUIREMENTS

[75] Inventors: Gerhard Quandt; Werner Ries; Joachim Richter, all of Heidelberg, Germany

[73] Assignee: Teldix G.m.b.H., Heidelberg, Germany

[21] Appl. No.: 753,807

[22] Filed: Dec. 23, 1976

[30] Foreign Application Priority Data

Dec. 24, 1975 Germany ..... 2558758

[51] Int. Cl.[2] ..... D01H 1/12

[52] U.S. Cl. ..... 57/58.89; 57/100

[58] Field of Search ..... 57/58.89–58.95, 57/56, 100

[56] References Cited

U.S. PATENT DOCUMENTS

| | | | |
|---|---|---|---|
| 3,367,099 | 2/1968 | Kubovy et al. | 57/58.89 |
| 3,698,175 | 10/1972 | Dykast | 57/58.89 |
| 3,837,153 | 9/1974 | Didek et al. | 57/58.89 X |
| 3,882,666 | 5/1975 | Muller | 57/58.89 X |
| 3,924,398 | 12/1975 | Esser et al. | 57/58.89 |
| 3,972,171 | 8/1976 | Handschuch et al. | 57/58.89 |
| 3,972,172 | 8/1976 | Waleckx | 57/58.89 |
| 3,981,132 | 9/1976 | Miyazaki et al. | 57/58.89 |
| 3,999,365 | 12/1976 | Suzuki | 57/58.89 X |

*Primary Examiner*—John Petrakes
*Attorney, Agent, or Firm*—Spencer & Kaye

[57] ABSTRACT

In an open end spinning unit having a stationary frame member and a spinning rotor rotatably supported by the frame member, and in which, during operation of the unit, a flow of gas occurs from the yarn removal opening and fiber inlet opening of the unit to a gas extraction opening thereof, the gas traversing a path surrounding the rotor, a gas flow controlling structure is disposed around the rotor to define a narrow gap with the exterior surface of a portion of the rotor, so that the space adjacent the remainder of the rotor is in communication with the gas flow path only via the narrow gap.

5 Claims, 1 Drawing Figure

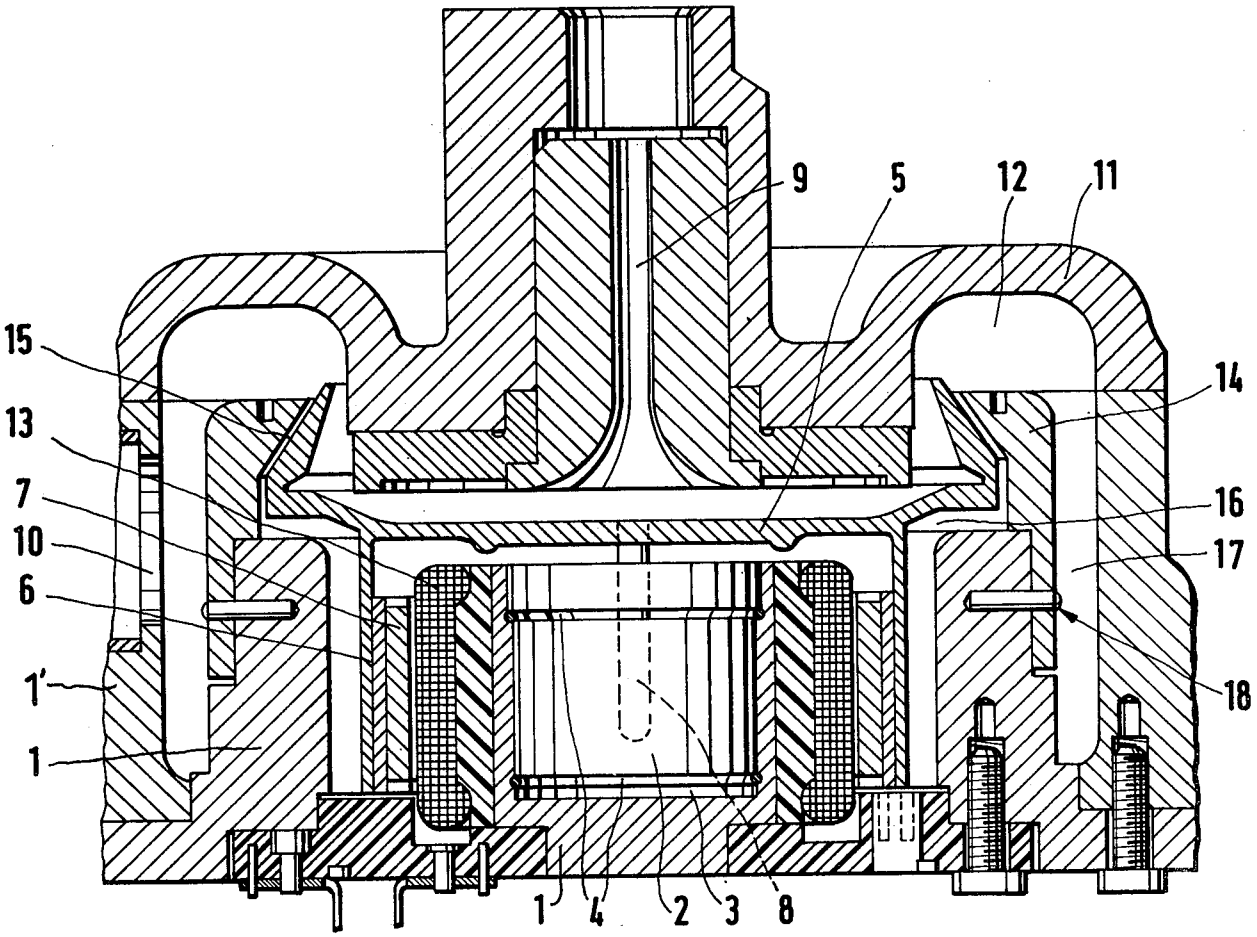
15
13
7
10
6
1'
1
9
5
12
11
14
16
17
18
8
3
2
4
1

OPEN END SPINNING UNIT HAVING REDUCED OPERATING POWER REQUIREMENTS

BACKGROUND OF THE INVENTION

The present invention relates to an open end spinning unit of the type including a spinning rotor, a bearing for the spinning rotor fastened to the machine and a drive for the spinning rotor, and during the operation of which gas is extracted from the area enclosing the spinning rotor to create a gas stream which flows from the fiber inlet opening and the yarn removal opening to an air, or gas, extraction opening.

Such an open end spinning unit is disclosed, for example, in German Offenlegungsschrift [Laid-Open Application] No. 2,135,525. In addition to the common drive for a plurality of spinning units disclosed therein, other spinning units driven by an integrated electric motor as drive are also known, one such unit being disclosed in German Offenlegungsschrift No. 2,404,241.

Particularly in the case of individual drives, and also for common drives, it is important to reduce the energy required for the drive. This is more important in the case of individual drives because increased energy requirements also involve the generation of increased heat which is difficult to dissipate due to the relatively small dimensions involved.

SUMMARY OF THE INVENTION

It is an object of the present invention to reduce the energy required for the drive of such a spinning unit.

These and other objects are achieved, according to the present invention, in an open end spinning unit having a stationary frame member presenting a yarn removal opening, a fiber inlet opening and a gas extraction opening, and a spinning rotor rotatably supported by the frame member and enclosed by the frame member, the region enclosed by the spinning rotor being via an adjacent space in communication with the yarn removal opening, the fiber inlet opening and the gas extraction opening, and, during operation of the spinning unit, a stream of gas flowing from the yarn removal opening and fiber inlet opening to the gas extraction opening, by the provision of a gas flow controlling structure fixed relative to the frame member, surrounding at least a portion of the rotor and defining a narrow gap with at least a portion of the outer surface of the rotor, such approximately separating the remainder of the rotor from the said space.

The invention is based on recognition of the fact that a significant portion of the energy required for driving such a spinning unit is consumed in the form of air friction losses resulting from the stream of air which is being guided along the outer surfaces of the spinning rotor. Based on this realization, the invention reduces the quantity of energy consumed in this manner by providing a structure in the vicinity of the outer surface of the spinning rotor to deflect the stream of gas so that it no longer flows along the outer surface of the spinning rotor. This structure may be fastened to the stationary part of the unit but it is also conceivable to attach it to the cover of the spinning unit.

Preferably this structure includes a ring set on and fastened to part of the stator of the spinning unit, which ring extends at least into the vicinity of the front edge of the spinning rotor and lies adjacent its outer surface so that a narrow gap is formed. The front edge of the spinning rotor is the edge surrounding its open end.

This ring thus effectively closes the rest of the area around the rotor from the area through which the gas flows, except for this gap.

Most advantageously, the ring is adapted on its side facing the outer surface of the spinning rotor to the contour of that outer surface so that only a small gap remains therebetween. It is of advantage with respect to the performance of the machine to have only a small cushion of air between the rotating and stationary parts.

The size of the gap is selected so that the spinning rotor, which, due to its floating suspension, may tend to be displaced transversely and to wobble, will in no case contact the ring.

If the motor of the individual drive is designed as an external rotor motor, as is disclosed, for example, in German Offenlegungsschrift [Laid-Open Application] No. 2,404,241 and corresponding pending U.S. application Ser. No. 695,551, filed June 14, 1976, then, according to a further feature of the invention, this rotor, or a conical drive rotor or any other nonexternal rotor, is disposed in a region shielded from the stream of air so that additional air friction losses created by the passage of the stream of air are avoided. It has been found that under certain circumstances up to 20% of the drive energy for each spinning unit can thus be saved.

BRIEF DESCRIPTION OF THE DRAWING

The sole FIGURE of the drawing is a cross-sectional, longitudinal view of one preferred embodiment of an open end spinning unit according to the invention.

DESCRIPTION OF THE PREFERRED EMBODIMENTS

The spinning unit illustrated in the FIGURE is of the type having an integrated drive motor. The stator 1 accommodates a bearing unit 2 which is elastically, or floatingly, suspended by means of O-rings 4 in an opening 3. The rotor, including the spinning rotor 5 and the motor rotor 6 carrying magnets 7 is mounted in this bearing unit by means of bushing pin 8. Drive windings 13 carried by stator 1 are disposed opposite, i.e. facing, magnets 7. Air can flow into the interior of the unit through yarn removal opening 9 and through a lateral opening (not visible) through which the fibers enter the spinning unit. Stator 1 includes a sleeve 1' surrounding at least part of the rotor 5, 6 and provided with an opening 10 connected to a suction source so that a stream of air flows toward opening 10 from the interior of the spinning rotor 5 through a passage defined by an annular recess 12 in the cover 11 of the unit, cover 11 being secured to stator 1 via sleeve 1'.

In order to reduce air friction losses, a ring 14 is placed on the stator 1. Ring 14 is contoured to be adapted to the contour of the outer surface of spinning rotor 5 and so that a small space, or gap, 15 remains between it and the spinning rotor. Ring 14 is attached so that only the small gap 15 provides communication between the annular chamber 16 surrounding rotor 5 and 6 and the chamber 17 enclosed by sleeve 1'. Therefore, there is virtually no way for the stream of air produced by the suction force applied to opening 10 to have an influence on the regions adjacent the outer surfaces of the spinning rotor 5 and the motor rotor 6. This results in a significant reduction in the drive energy requirement compared to an unshielded rotor.

Ring 14 may be screwed on or, as indicated in the FIGURE, it may be fastened to the stator 1 by means of a bayonet lock 18. Alternatively, ring 14 could be secured to cover 11.

The narrow gap 15 formed between ring 14 and spinning rotor 5 produces the additional advantage that the floatingly mounted spinning rotor 5 is stabilized, i.e. wobbling movements of the entire rotor are, at least, reduced. The gas in the gap here acts as an air bearing. The gap 15 can have a thickness of perhaps 0.1 to 0.5 mm, for example 0.3 mm. The spinning rotor can have a maximum diameter of 40 to 80 mm preferable 60 mm and can rotate up to 60.000 RPM.

It will be understood that the above description of the present invention is susceptible to various modifications, changes and adaptations, and the same are intended to be comprehended within the meaning and range of equivalents of the appended claims.

What is claimed is:

1. In an open end spinning unit having a stationary frame member presenting a yarn opening, a fiber inlet opening and a gas extraction opening, and a spinning rotor rotatably supported by the frame member and enclosed by the frame member, the stationary frame member and the spinning rotor together defining a gas flow space via which gas flows from the yarn removal opening and the fiber inlet opening to the gas extraction opening during operation of the spinning unit, and further defining an annular space coextensive with a portion of the axial extent of the rotor, the improvement comprising gas flow controlling means fixed relative to said frame member, surrounding at least a portion of said rotor and defining a narrow gap with the outer surface of said rotor which provides the only communication between said gas flow space and said annular space for substantially eliminating the flow of gas streams into said annular space.

2. An arrangement as defined in claim 1 wherein said gas flow controlling means comprise a ring fixed to said frame member and extending adjacent the outer surface of said rotor adjacent the open end thereof.

3. An arrangement as defined in claim 2 wherein the surface of said ring facing the outer surface of said spinning rotor is shaped to conform to the contour of the outer surface of said spinning rotor and extends to within the immediate vicinity of said outer surface.

4. An arrangement as defined in claim 2 further comprising an external motor rotor attached to said spinning rotor and constituting the rotor of a motor driving said spinning rotor, said motor rotor being disposed in a space which communicates with the said annular space.

5. An arrangement as defined in claim 1 wherein the portion of said rotor which is coextensive with said annular space and the portion of said rotor surrounded by said controlling means together constitute substantially the entire axial extent of said rotor.

* * * * *